US005443576A

United States Patent [19]

Hauter

[11] Patent Number: 5,443,576

[45] Date of Patent: Aug. 22, 1995

[54] SOCCER TRAINING BELT FOR USE WTIH A CORD SUSPENDED SOCCER BALL

[76] Inventor: Bradley D. Hauter, 433 Harvest Gate, Lake In The Hills, Ill. 60102

[21] Appl. No.: 273,761

[22] Filed: Jul. 12, 1994

[51] Int. Cl.[6] ..... A63B 67/10

[52] U.S. Cl. ..... 273/58 C; 273/414; 273/DIG. 19; 273/DIG. 30

[58] Field of Search ..... 273/58 C, DIG. 30, DIG. 17–DIG. 19, 273/414, 413, 26 R, 26 C, 1.5 A, 29 A; 434/251

[56] References Cited

U.S. PATENT DOCUMENTS

| | | | |
|---|---|---|---|
| 667,563 | 2/1901 | Oakley | 273/DIG. 19 |
| 3,782,727 | 1/1974 | Chirnomas . | |
| 3,863,924 | 2/1975 | Gagnon . | |
| 4,003,575 | 1/1977 | Hobbs | 273/DIG. 19 |
| 4,021,035 | 5/1977 | O'Hara | 273/DIG. 19 |
| 4,042,241 | 11/1977 | Collins . | |
| 4,059,271 | 11/1977 | Depre . | |
| 4,071,241 | 1/1978 | Cortes Garcia . | |
| 4,121,822 | 10/1978 | DiSabatino . | |
| 4,156,574 | 5/1979 | Boden . | |
| 4,687,209 | 10/1987 | Carey . | |
| 4,871,178 | 10/1989 | Diaz . | |
| 5,080,376 | 1/1992 | Lerner et al. . | |
| 5,094,462 | 3/1992 | Boyle et al. . | |
| 5,165,696 | 11/1992 | Saha . | |
| 5,199,715 | 4/1993 | May . | |
| 5,244,206 | 9/1993 | Clark et al. . | |
| 5,358,258 | 10/1994 | Killion | 273/29 A |

*Primary Examiner*—Vincent Millin
*Assistant Examiner*—Steven B. Wong
*Attorney, Agent, or Firm*—Charles F. Meroni, Jr.

[57] ABSTRACT

A soccer training apparatus is provided. The apparatus has a mesh soccer net sized for encapsulating a soccer ball. A cord having a first end and a securing portion is provided. The first end of the cord is attached to the mesh soccer net. A waist belt having an inner lapped belt end and an outer lapped belt end is also provided. Hook and loop fastening means provided on confronting faces of the inner lapped belt end and outer lapped belt end secure the inner lapped belt end and outer lapped belt end in detachable assembly together. The outer lapped belt end having an elongated slot of sufficient size to permit a soccer ball to be inserted through the elongated slot of the waist belt. An adjusting lock holds the securing portion of the cord to the inner lapped belt end leaving the mesh soccer net carrying the soccer ball suspended from the waist belt.

17 Claims, 2 Drawing Sheets

SOCCER TRAINING BELT FOR USE WTIH A CORD SUSPENDED SOCCER BALL

BACKGROUND OF THE INVENTION

1. Field of the Invention

The present invention relates generally to a soccer training device, and more particularly, to a soccer training belt for use with a cord suspended soccer ball.

2. Description of the Prior Art

Many different types of soccer training devices are known in the art. An important object of these devices is to provide a way for an individual to practice his or her soccer technique alone.

U.S. Pat. No. 5,094,462 issued to Boyle et al., discloses a soccer training device having a net which holds a soccer ball. An elastic cord is connected to the net on one end and is connected to a wrist or ankle strap on the other end. This invention, however, suffers from a number of disadvantages. The use of an elastic cord allows a returning soccer ball to gain in speed making it difficult for younger players to develop their technique. The use of a wrist or ankle strap will provide for an untrue return of the soccer ball due to an increased human variability in the changing positioning of a player's arms or legs.

U.S. Pat. No. 4,042,241 issued to Collins, discloses a soccer training device having elastic cord which is attached at one end to a soccer ball and at its other end to a flexible loop which fits around the foot, head or neck. Like the device by Boyle el al., the use of elastic cord creates a disadvantage for younger players. In addition, the Collins device attaches the elastic cord directly to the soccer ball. This form of attachment suffers from a number of disadvantages. The point of attachment creates a knob like structure on the ball which will prevent the ball from flying straight and returning straight. The natural rotational forces of a kicked ball will be hindered because the ball is directly connected to the cord. If a player where to kick the ball at the point of attachment, the knob like structure would prevent the player from obtaining a natural kick. In a worst case, the player could injure his or her foot.

U.S. Pat. No. 5,080,376 issued to Lerner et al. and U.S. Pat. No. 4,687,209 issued to Carey, disclose soccer training devices. Both devices suffer from some the same disadvantages previously stated in that the devices have a tether which is secured directly to the ball.

A more desirable soccer training device is one which would allow for a more true or natural kick of the ball, would be applicable for players of all ages and skill levels, and would provide a more consistent return location of the ball.

SUMMARY OF THE INVENTION

Accordingly, it is an object of this invention to provide a soccer training apparatus which does not restrict the arms or legs of a player.

Another object of the present invention is to provide a soccer training apparatus which will provide a truer and more natural kick and flight of a ball.

Still another object of the present invention is to provide a soccer training apparatus which will allow a player to adjust the length of an attached cord.

Yet another object of the present invention is to provide a soccer training apparatus which is usable by players of all sizes and shapes.

To achieve the foregoing and other objectives, and in accordance with the purposes of the present invention a soccer training apparatus is provided. The apparatus has a mesh soccer net sized for encapsulating a soccer ball. A cord having a first end and a securing portion is provided. The first end of the cord is attached to the mesh soccer net. A waist belt having an inner lapped belt end and an outer lapped belt end is also provided. Hook and loop fastening means provided on confronting faces of the inner lapped belt end and outer lapped belt end secure the inner lapped belt end and outer lapped belt end in detachable assembly together. The outer lapped belt end has a slot of sufficient size to permit insertion of the cord through the slot.

In accordance with an aspect of the invention, the slot is elongated and of sufficient size to permit a soccer ball to be inserted through the elongated slot of the waist belt. An adjusting lock holds the securing portion of the cord to the inner lapped belt end leaving the mesh soccer net carrying the soccer ball suspended from the waist belt.

In accordance with another aspect of the invention a strap is provided on the waist belt for securing a length of the cord to the waist belt at a point on the waist belt remote from where the inner lapped belt end and outer lapped belt end are engaged for allowing a distance between the mesh soccer net and the adjusting lock to be varied.

In accordance with yet another aspect of the invention the cord is physically attached at the first end to the mesh soccer net in a drawstring type fashion by gathering the mesh soccer net so that the mesh soccer net encapsulates the soccer ball.

In a soccer training apparatus, comprising a mesh soccer net sized for encapsulating a soccer ball, and a cord physically attached at a first end to the mesh soccer net, the improvement comprises a waist belt having an inner lapped belt end and an outer lapped belt end, hook and loop fastening means provided on confronting faces of the inner lapped belt end and outer lapped belt end for securing the inner lapped belt end and outer lapped belt end in detachable assembly together, means for securing a portion of the cord to the inner lapped belt end, and the outer lapped belt end having an elongated slot of sufficient size to permit a soccer ball to be inserted through the elongated slot of the waist belt leaving the mesh soccer net carrying the soccer ball suspended from the waist belt.

Other objects, features and advantages of my invention will become more readily apparent upon reference to the following description when taken in conjunction with the accompanying drawings.

DETAILED DESCRIPTION OF THE PREFERRED EMBODIMENT

Figure 1:
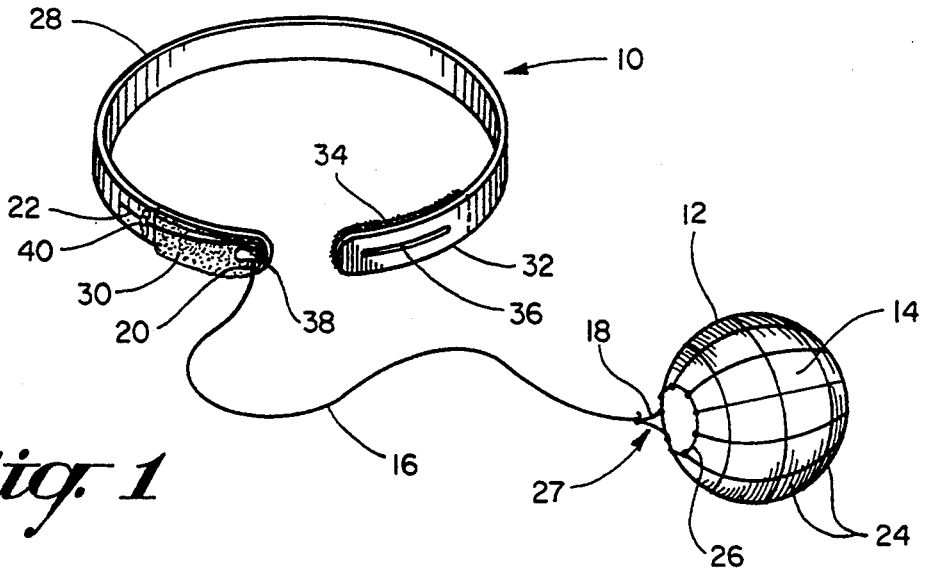
FIG. 1 is a perspective view of the apparatus.

Referring now to the drawings, FIG. 1 illustrates a soccer training apparatus 10. The apparatus 10 has a mesh soccer net 12 sized for encapsulating a soccer ball 14. Preferably, the mesh soccer net 12 is made from a strong lightweight material, such as nylon.

Figure 2:
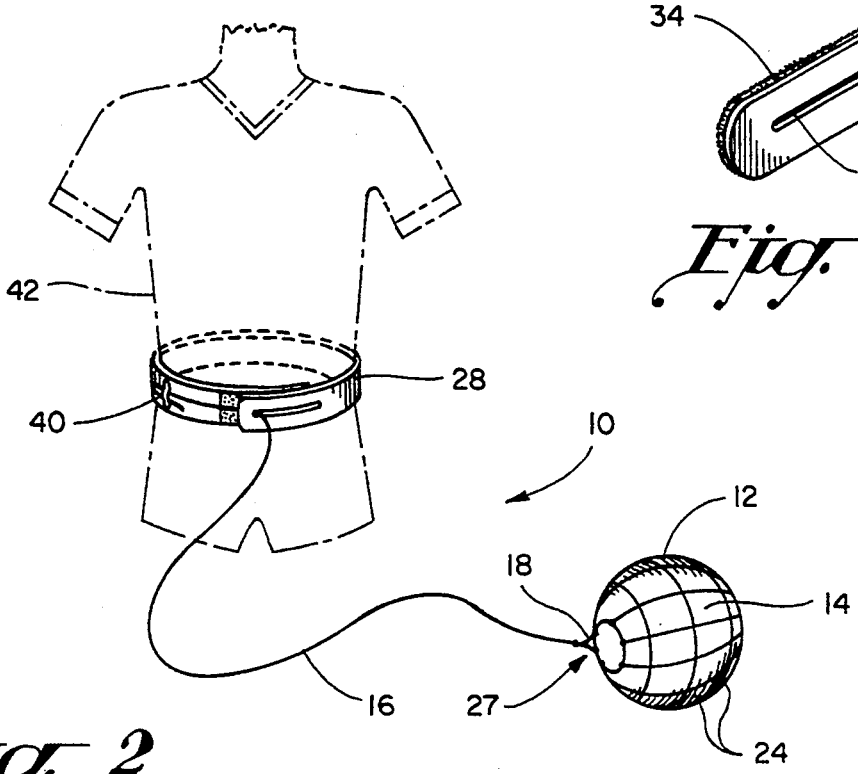
FIG. 2 is perspective view of the apparatus being worn by a player.
Figure 4:
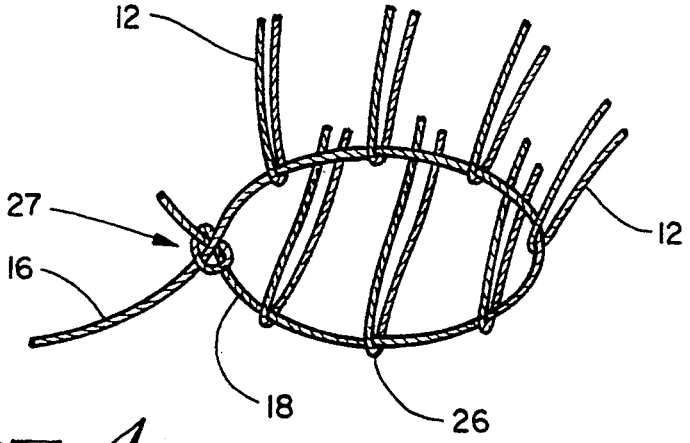
FIG. 4 is fragmentary perspective view of the cord connected to the mesh soccer net.

A non-elastic tether or cord 16 has a first end 18, a securing portion 20, and a second end 22. The first end 18 of the cord 16 is attached to the mesh soccer net 12. Preferably, the cord 16 is physically attached at the first end 18 to the mesh soccer net 12 in a drawstring type fashion by gathering the mesh soccer net 12. This may be achieved in number of different configurations where the cord 16 is looped or threaded through a number of soccer net holes 24 around the edges of a net opening 26 of the mesh soccer net 12, as best illustrated in FIG. 4. As shown in FIGS. 1 and 2, the net opening 26 of the mesh soccer net 12 is then gathered or cinched closed, so that the mesh soccer net 12 encapsulates the soccer ball 14. The cord 16 is made from a strong lightweight material, such as nylon.

Preferably, the first end 18 of the cord 16 is slidably connected to the cord 16 for opening and closing of the mesh soccer net 12 in the drawstring type fashion described above. This may be achieved with the use of a slide type knot 27, a small ring or circle mounted on the very tip of the first end 18 of the cord 16, which would encircle the cord 16 in a slidable manner, or any other type of commonly known method used to secure the end of a drawstring.

A waist belt 28 has an inner lapped belt end 30 and an outer lapped belt end 32. Hook and loop type fasteners or hook and loop fastening means 34, such as VELCRO, are provided on confronting faces of the inner lapped belt end 30 and outer lapped belt end 32 for securing the inner lapped belt end 30 and outer lapped belt end 32 in detachable assembly together. This is best achieved by providing the waist belt 28 with hook and loop fastening means 34 on both sides of the entire waist belt 28. The waist belt 28 itself is preferably formed by a double sided hook and loop fastening material, where one sided is mated for engagement of the other side. In an alternative embodiment, the waist belt is formed from a material, such as cotton or nylon, with the hook and loop fastening means 34 connected to the outer surfaces of the waist belt. The waist belt may also be formed from an elastic material.

Figure 3:
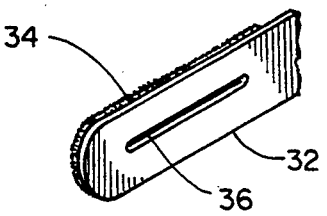
FIG. 3 is fragmentary side view of an alternative embodiment of the outer lapped belt end.

The outer lapped belt end 32 has a slot 36 of sufficient size for insertion of the cord 16 through it, as shown in FIG. 3. In a preferred embodiment, the slot 36 is elongated and of sufficient size to permit a soccer ball of any variety to be inserted through, as shown in FIG. 1.

Figure 5:
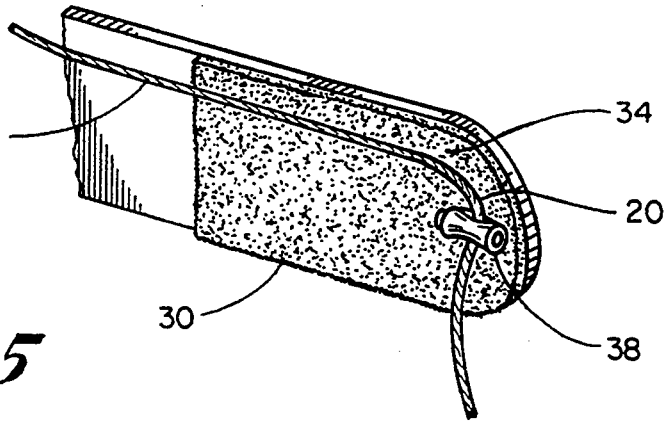
FIG. 5 is fragmentary side view of the inner lapped belt end.

As best illustrated in FIG. 5, the inner lapped belt end 30 contains a length adjusting lock 38 for securing the securing portion 20 of the cord 16 to the inner lapped belt end 30. This length adjusting lock 38 can be of any sort of adjusting clamp, clasp, cord locking device, or spring loaded cord lock, all of which are known to one skilled in the art.

Figure 6:
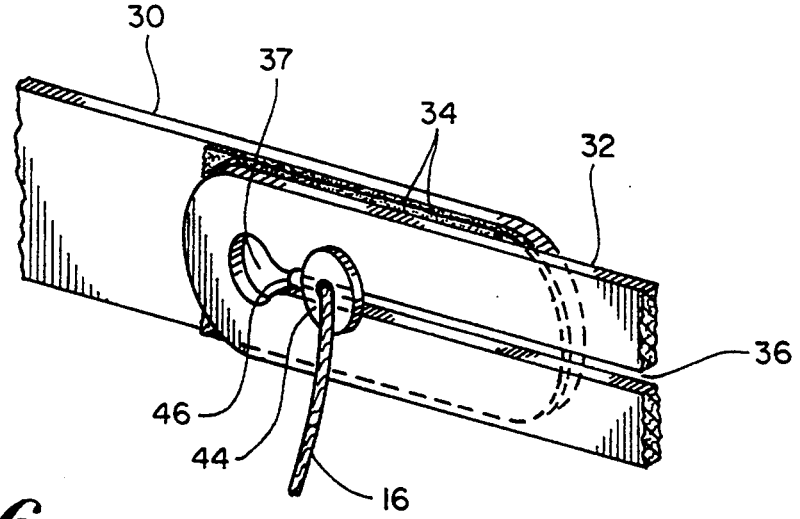
FIG. 6 is fragmentary side view of an alternative embodiment for the inner and outer lapped belt ends.

It is to be understood that in an alternative embodiment, the cord 16 could be permanently secured to the inner lapped belt end 30. In another embodiment shown in FIG. 6, a spring loaded retractable reel 44 having a reel lock 46 is provided instead of the length adjusting lock 38. The reel 44 is connected to the inner lapped belt end 30 at a bottom reel portion which is of a diameter less than the reel 44. The reel 44 is readily available commericially and is commonly used for dog leashes, tape measures, and extension cords. When lap engaging the outer lapped belt end 32 to the inner lapped belt end 30, the slot 36 may have a larger slot end 37 for easily inserting the reel 44 through the outer lapped belt end 32.

A strap 40 is provided on the waist belt 28 for securing the second end 22 of the cord 16 to the waist belt 28 at a point on the waist belt 28 remote from where the inner lapped belt end 30 and outer lapped belt end 32 are engaged. This allows for a distance between the mesh soccer net 12 and the adjusting lock 38 to be varied. Preferably, the strap 40 has a hook and loop fastening means on one side thereof for attachment to the hook and loop fastening means on the inner lapped belt end 30. It is to be understood that Other types of straps, hooks, or tying or securing means could equally be used in securing the second end 22 of the cord 16 to the waist belt 28.

In use, the apparatus 10 is placed around the waist of a player 42, as shown in FIG. 2. The soccer ball 14 which can be previously secured in the mesh soccer net 12 is then placed through the elongated slot 36 of the outer lapped belt end 32, along with the attached cord 16. Next, the outer lapped belt end 32 is adjustably secured to the inner lapped belt end 30. The adjusting lock 38 is exposed through elongated slot 36. When forces are exerted on the cord 16 during practice, the inner lapped belt end 30 will be pressed against the outer lapped belt end 32, which will continually keep the confronting faces of hook and loop fastening means secured.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. In a soccer training apparatus, comprising a mesh soccer net sized for encapsulating a soccer ball, a cord physically attached at a first end to the mesh soccer net, and a waist belt connected to the cord, the improvement comprising, the waist belt having an inner lapped belt end and an outer lapped belt end, hook and loop fastening means provided on confronting faces of the inner lapped belt end and outer lapped belt end for securing the inner lapped belt end and outer lapped belt end in detachable assembly together, means for securing a portion of the cord to the inner lapped belt end, and the outer lapped belt end having an elongated slot of sufficient size to permit a soccer ball to be inserted through the elongated slot of the waist belt leaving the mesh soccer net carrying the soccer ball suspended from the waist belt.

2. The soccer training apparatus of claim 1, further comprising means on the waist belt for securing a length of the cord to the waist belt at a point on the waist belt remote from where the inner lapped belt end and outer lapped belt end are engaged for allowing a distance between the mesh soccer net and the means for securing the portion of the cord to the inner lapped belt end to be varied.

3. The soccer training apparatus of claim 1, wherein the cord is physically attached at the first end to the mesh soccer net in a drawstring type fashion by gathering the mesh soccer net so that the mesh soccer net encapsulates the soccer ball.

4. The soccer training apparatus of claim 3, wherein the first end of the cord is slidably connected to the cord for opening and closing of the mesh soccer net in a drawstring type fashion.

5. The soccer training apparatus of claim 1, wherein the cord is non-elastic.

6. The soccer training apparatus of claim 1, wherein the mesh soccer net formed a nylon material.

7. A soccer training apparatus, comprising:

(a) a mesh soccer net sized for encapsulating a soccer ball;

(b) a cord having a first end and a securing portion, the first end being attached to the mesh soccer net;

(c) a waist belt having an inner lapped belt end and an outer lapped belt end, hook and loop fastening means provided on confronting faces of the inner lapped belt end and outer lapped belt end for securing the inner lapped belt end and outer lapped belt end in detachable assembly together, the outer lapped belt end having a slot of sufficient size to permit insertion of the cord through the slot; and (d) means for securing the securing portion of the cord to the inner lapped belt end leaving the mesh soccer net carrying the soccer ball suspended from the waist belt.

8. The soccer training apparatus of claim 7, further comprising means on the waist belt for securing a length of the cord to the waist belt at a point on the waist belt remote from where the inner lapped belt end and outer lapped belt end are engaged for allowing a distance between the mesh soccer net and the means for securing the portion of the cord to the inner lapped belt end to be varied.

9. The soccer training apparatus of claim 7, wherein the cord is physically attached at the first end to the mesh soccer net in a drawstring type fashion by gathering the mesh soccer net so that the mesh soccer net encapsulates the soccer ball.

10. The soccer training apparatus of claim 9, wherein the first end of the cord is slidably connected to the cord for opening and closing of the mesh soccer net in a drawstring type fashion.

11. The soccer training apparatus of claim 7, wherein the cord is non-elastic.

12. The soccer training apparatus of claim 7, wherein the mesh soccer net formed a nylon material.

13. The soccer training apparatus of claim 7, wherein the waist belt is formed from an elastic material.

14. The soccer training apparatus of claim 7, wherein the slot is elongated and of sufficient size to permit a soccer ball to be inserted through the slot of the waist belt.

15. A soccer training apparatus, comprising:

(a) a mesh soccer net sized for encapsulating a soccer ball;

(b) a non-elastic cord having a first end, a securing portion, and a second end, the first end being attached to the mesh soccer net;

(c) an waist belt having an inner lapped belt end and an outer lapped belt end, hook and loop fastening means provided on confronting faces of the inner lapped belt end and outer lapped belt end for securing the inner lapped belt end and outer lapped belt end in detachable assembly together, the outer lapped belt end having an elongated slot of sufficient size to permit a soccer ball to be inserted through the elongated slot of the waist belt;

(d) means for securing the securing portion of the cord to the inner lapped belt end leaving the mesh soccer net carrying the soccer ball suspended from the waist belt; and (e) means on the waist belt for securing the second end of the non-elastic cord to the waist belt at a point on the waist belt remote from where the inner lapped belt end and outer lapped belt end are engaged for allowing a distance between the mesh soccer net and the means for securing the securing portion of the cord to the inner lapped belt end to be varied.

16. The soccer training apparatus of claim 15, wherein the non-elastic cord is physically attached at the first end to the mesh soccer net in a drawstring type fashion by gathering the mesh soccer net so that the mesh soccer net encapsulates the soccer ball.

17. The soccer training apparatus of claim 16, wherein the first end of the non-elastic cord is slidably connected to the non-elastic cord for opening and closing of the mesh soccer net in a drawstring type fashion.

* * * * *